US006868894B2

(12) United States Patent
Knudsen

(10) Patent No.: US 6,868,894 B2
(45) Date of Patent: Mar. 22, 2005

(54) CORE SETTER FOR MATCHPLATE MOULDING MACHINE

(75) Inventor: Søren Erik Knudsen, Værløse (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 10/433,001

(22) PCT Filed: Nov. 30, 2000

(86) PCT No.: PCT/DK00/00657

§ 371 (c)(1),
(2), (4) Date: May 29, 2003

(87) PCT Pub. No.: WO02/43901

PCT Pub. Date: Jun. 6, 2002

(65) Prior Publication Data

US 2004/0011499 A1 Jan. 22, 2004

(51) Int. Cl.[7] ..... B22D 33/04
(52) U.S. Cl. ..... 164/340; 164/341
(58) Field of Search ..... 164/137, 339–341

(56) References Cited

U.S. PATENT DOCUMENTS 3,424,229 A * 1/1969 Gunnergaard-Poulsen .. 164/340
3,630,268 A * 12/1971 Hatch ..... 164/181
3,910,343 A * 10/1975 Popov et al. ..... 164/340
4,463,794 A * 8/1984 Shioda ..... 164/182
4,565,232 A * 1/1986 Abraham ..... 164/181
4,590,982 A * 5/1986 Hunter ..... 164/253
4,848,440 A * 7/1989 Hunter ..... 164/253

* cited by examiner

*Primary Examiner*—Kiley S. Stoner
*Assistant Examiner*—Kevin L. McHenry
(74) *Attorney, Agent, or Firm*—Stites & Harbison PLLC; Douglas E. Jackson

(57) ABSTRACT

A molding machine for providing flaskless molds comprising a drag flask (4) and a cope flask (3) is provided with a core setter (40) for placing cores in upwardly facing cavities of a mold located in the drag flask (4). The core setter (40) comprises a core mask (45) with pockets (49) selectively operable to hold and release cores (50), said core mask being supported by a holder (55) that is pivotally journalled around a horizontal axis to swing between a core-releasing position and a core-loading position. The core mask (45) faces downwardly towards the mold when it is in the core-releasing position and faces laterally away from said mold when it is in the core-loading position. The drag flask (4) is arranged to be movable in a substantially horizontal direction to and from a core-setting position directly under the core mask (45) in its core-releasing position. The drag flask (4) is arranged to be movable upwards to and downwards from the core mask (45) when it is in the core-setting position. When the core mask (4) has been loaded with the cores (50), it is swung to the core-releasing position. The drag flask (4) is then moved from its position under the core mask (45). The drag flask (4) is then moved up towards the core mask (45) and the cores (50) are pressed into the cavities (49) in the mold. The cores (50) are then released by the core setter (40) and the drag flask (4) moves back to its position under the cope flask (3).

8 Claims, 9 Drawing Sheets

CORE SETTER FOR MATCHPLATE MOULDING MACHINE

TECHNICAL FIELD

The present invention relates to a moulding machine for producing flaskless moulds which is provided with means for automatically placing cores in the cavities of sand moulds produced by the moulding machine.

BACKGROUND ART

An automatic core setting machine is disclosed in U.S. Pat. No. 4,590,982. In that machine the cores are carried in pockets in a mask which places the cores in the cavities of the moulds. Typically the cores are held by vacuum. The apparatus is suited for placing cores in moulds that have upwardly opening mould cavities. Hereto the core mask is swung downwardly and laterally through a short arc from a core-loading position to a pre-setting position and then is lowered vertically to a core-releasing position to place the cores in the mould. When the mask is in its loading position, its pockets face away from the mould station to enable the cores to be loaded in the pockets from the side of the machine. In order to carry out the combined rotational, lateral and vertical movement, the mask holder is guided by a complex linkage mechanism. Core placing must, however, be precise and requires relatively high forces for pressing the cores into the mould cavities. Moreover, the forces must not deform the construction since this could lead to core fracturing. It is very difficult to fulfil these criteria with the complex linkage mechanism of the known core-setting machine.

DISCLOSURE OF THE INVENTION

On this background, it is the object of the present invention to provide a moulding machine for producing flaskless moulds of the kind referred to initially, which overcomes the above-mentioned problems. This object is achieved in accordance with a moulding machine for producing flaskless moulds comprising a drag flask and a cope flask arranged to be movable relatively towards one another, a core setter for placing cores in upwardly facing cavities of a mould located in the drag flask, the core setter comprising a core mask with pockets selectively operable to hold and release cores, said core mask being supported by a holder that is pivotably journalled around a horizontal axis to swing between a core-releasing position and a core-loading position, the core mask facing downwardly towards the mould when it is in the core-releasing position and facing laterally away from said mould when it is in the core-loading position, the drag flask being arranged to be movable in a substantially horizontal direction to and from a core setting position directly under the core mask in its core-releasing position, and the drag flask being arranged to be movable upwards to- and downwards from the core mask when it is in the core setting position.

By using the drag flask to execute the vertical movement of the mould towards the core mask, the construction of the guiding mechanism for swinging the mask between a core-loading position and a core-releasing position can be significantly simplified. This results in a stiffer and more precise guiding mechanism.

According to an embodiment of the invention, the guiding mechanism is formed by lateral shaft that is pivotally supported by the frame of the moulding machine.

According to another embodiment, the stiffness of the construction may be further increased by comprising points of support in the form of braces fixed to the base frame which give support in a vertical direction and which come in contact with the holder when it is in the core-releasing position for reducing bending of the holder when the cores are pressed into the mould.

According to yet another embodiment, the holder is pivotably journalled around another substantially vertical axis for swinging the core setter away from a core setting area of the moulding machine in order to make place for manual core setting or manual blowing off of residual sand on a mould.

The core mask holder is according to an embodiment formed as a half-open box and forms together with the core mask a vacuum manifold for retaining the cores.

BRIEF DESCRIPTION OF THE DRAWINGS

In the following detailed part of the present description, the invention will be explained in more detail with reference to the exemplary embodiments of the moulding machine for producing flaskless moulds according to the invention shown in the drawings, in which.

DESCRIPTION OF THE PREFERRED EMBODIMENT

Figure 1:
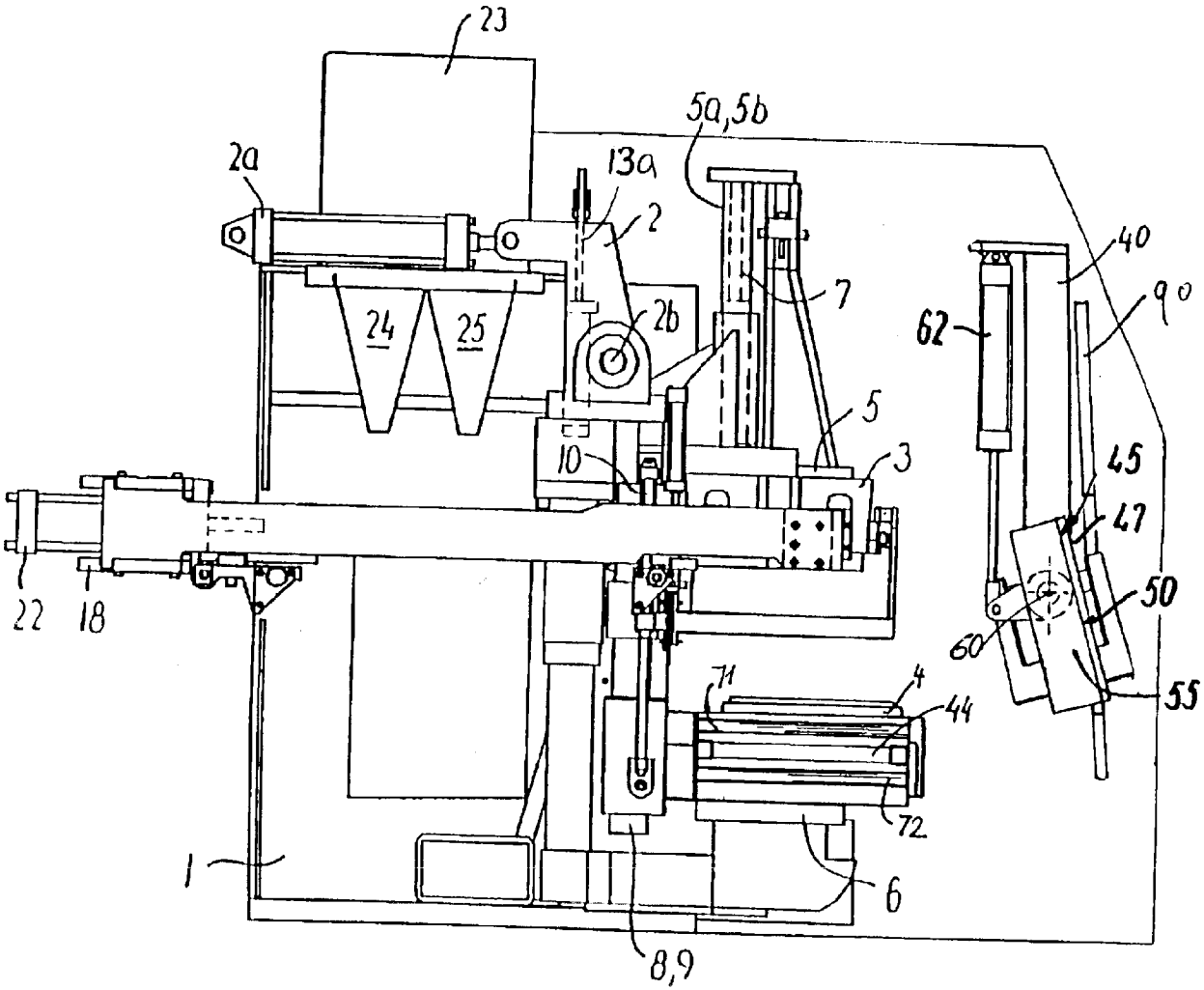
FIG. 1 shows a view of the moulding machine from the side with the core mask in the core-loading position.

The moulding machine shown in FIGS. 1 to 9 is provided with a base frame 1 which carries the other components of the machine. A swing frame 2 is rotatably mounted to the base frame 1 through a shaft 2*b*, the swing frame 2 can be rotated by a hydraulic cylinder 2*a*. The swing frame 2 supports the cope flask 3 and the drag flask 4 as well as the first squeeze plate 5 and the second squeeze plate 6.

The cope flask 3 is fixed on the swing frame 2. The first squeeze plate 5 is suspended by two guide rods 5*a*, 5*b* from the swing frame. The upper ends of the guide rods 5*a*, 5*b* are connected to one another by a bracket 33. A hydraulic actuator 7 enables the first squeeze plate to be moved up and down. The first squeeze plate 5 is movably fitted in the cope flask 3.

A drag flask 4 is disposed below the cope flask 3. The drag flask 4 is suspended from the swing frame 2 by a pair of guide rods 8, 9 to allow a linear movement with respect to the latter. Two hydraulic actuators 10 are fastened with one end of the drag flask 4 and at the opposite end to the swing frame 2. Thus, the drag flask 4 can be moved up and down by the second hydraulic actuators 10 in order to move the drag flask 4 up towards and away from the cope flask 3.

The drag flask 4 is further suspended from the swing frame by a second pair of horizontally extending guide rods 71,72 to allow a linear movement from a position directly under the cope flask 3 to a core-setting position directly under the core mask 45 (cf. FIG. 3) (when it is in its core-releasing position as explained below). A pair of seventh hydraulic actuators 44 is fastened at on end to the swing frame 2 and with its opposite end to the drag flask 4. Thus the drag flask 4 can be moved back and forth under the action of the seventh hydraulic actuator 44.

Figure 9:
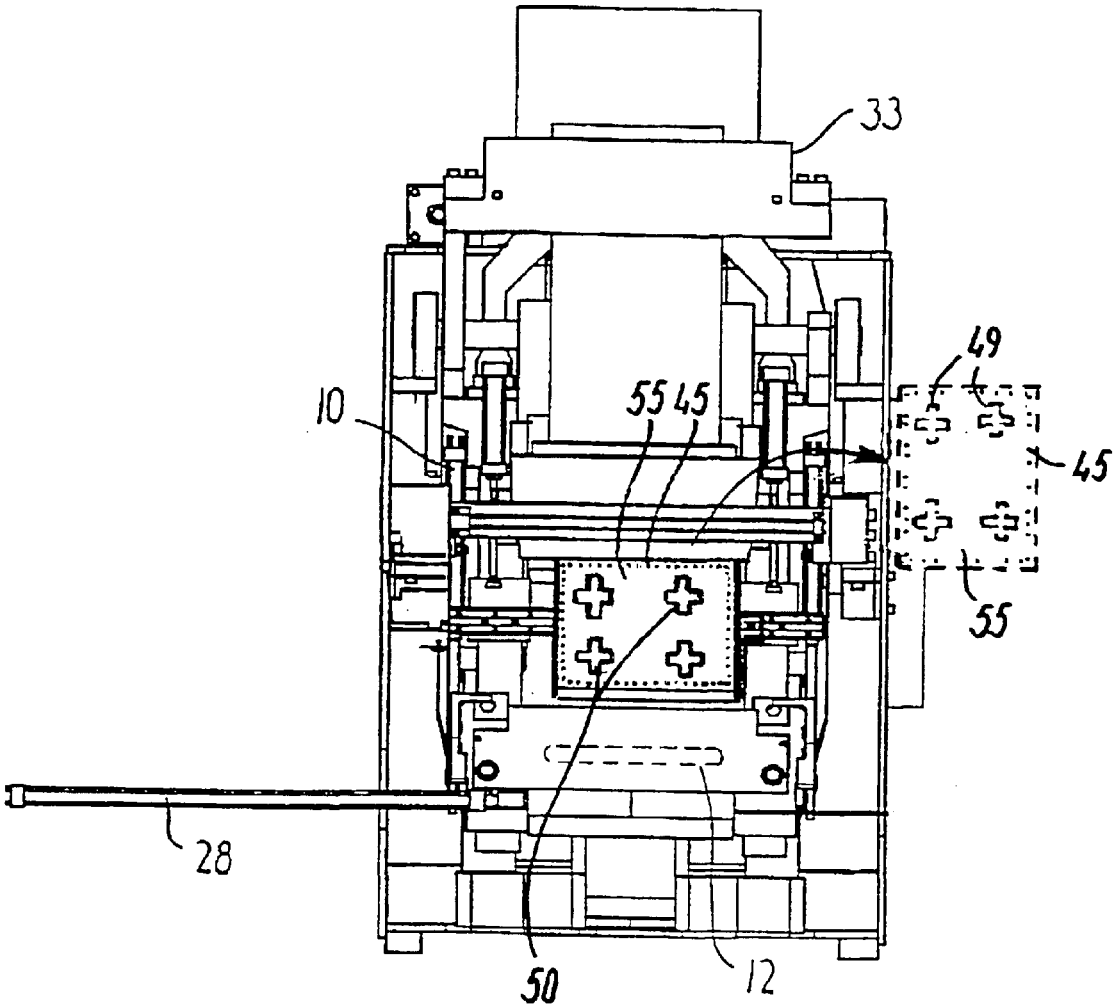
FIG. 9 is a front view of the moulding machine in which the core mask is moved into an inactive position away from the core setting area.

The cope flask 3 and the drag flask 4 define on their left-side wall ("left" as in FIG. 1) a sand-charging opening 12 (FIG. 9). These sand-charging openings are placed such that they abut with the sand-blowing nozzles 24, 25, when the cope flask 3 and the drag flask 4 are rotated by the swing frame 2 to the vertical position.

A pattern plate is suspended from the swing frame 2 in order to allow a horizontal translative movement on the pattern plate in and out of the space between the flasks 3, 4. A fourth hydraulic actuator (not shown) enables movement of the pattern plate in and out of the moulding machine.

A compression frame 18 carried by the base frame 1 extends horizontally, and is suspended from the base frame so as to allow horizontal transmitted movement in order to allow equalization of the force exercised on the squeeze plate 5, 6. A fifth hydraulic actuator 22 is fastened to one end of the compression frame 18 and can act on the second squeeze plate 6. The compression frame 18 transmits the force to its other end in order to apply the same force to the first squeeze plate 5.

A blowhead 23 with a sand-inlet part of the top to sand-blowing nozzles 24, 25 is attached to the base frame 1 in a position so that the sand-blowing nozzles 24, 25 will engage the respective sand-charging openings 12 of the drag flask and the cope flask when the latter are in their vertical position.

The core setter 40 comprises a core mask 45 having a flat side 47 provided with pockets 49 (FIG. 9) for receiving cores 50. The core mask 45 is selectively operable to hold and release cores 50. The cores are retained in the pockets 49 by applying a vacuum. A holder (core frame 55) holds the core mask. The core frame 55 is connected to a source of vacuum (not shown) for selectively applying vacuum to hold the cores 50 in the pockets 49. The core mask 45 is pivotally suspended by a first horizontal shaft 60 for allowing a pivotal movement between the core-loading position and the core-releasing position. An eighth hydraulic actuator 62 is operatively connected to the core frame 55 to effect the swinging movement of the core mask 45 between the core-loading and the core-releasing position.

The core frame 55 is supported in the core-releasing position by braces 70 which are fixed to the base frame 1. Preferably the three corners of the core frame 55 (the fourth being occupied by the horizontal shaft 60) are engaged by the braces 70 in the core-releasing position of the core frame 55. The force with which the drag flask 4 pushes upwards to the core mask 45 is considerable. The braces 70 minimize deformation of the core mask 45 during this phase, thereby reducing the risk of core rupture.

The shaft 60 is directly suspended from a subframe 80 and is thus only indirectly suspended from the base frame 1. The subframe 80 is suspended from the base frame 1 by a second substantially horizontal axis. The core setter 40 including the shaft 60, the core frame 55 and the core mask 45 can thus be swung from an active position to an inactive (dotted lines) position away from the core setting area of the moulding machine (cf. FIG. 9). This movement is performed manually. This allows manual core setting directly in the mould in the drag flask 4 and/or blowing of residual sand on the mould or in the mould cavities with compressed air.

A light curtain 90 secures the core-setting area, whereby a part of the light curtain, that is interrupted by the core frame 55 when it is in the core-loading position, is deactivated so that the operation of the machine is not interrupted, when the holder is in the core-loading position.

Operation of the Machine

The core mask 45 is loaded with cores in a convenient manner when the core mask 45 is in the position shown in FIG. 1 where the flat side 47 of the core mask 45 forms an angle of about 15° with the vertical so that the core mask 45 faces slightly upwards.

Figure 2:
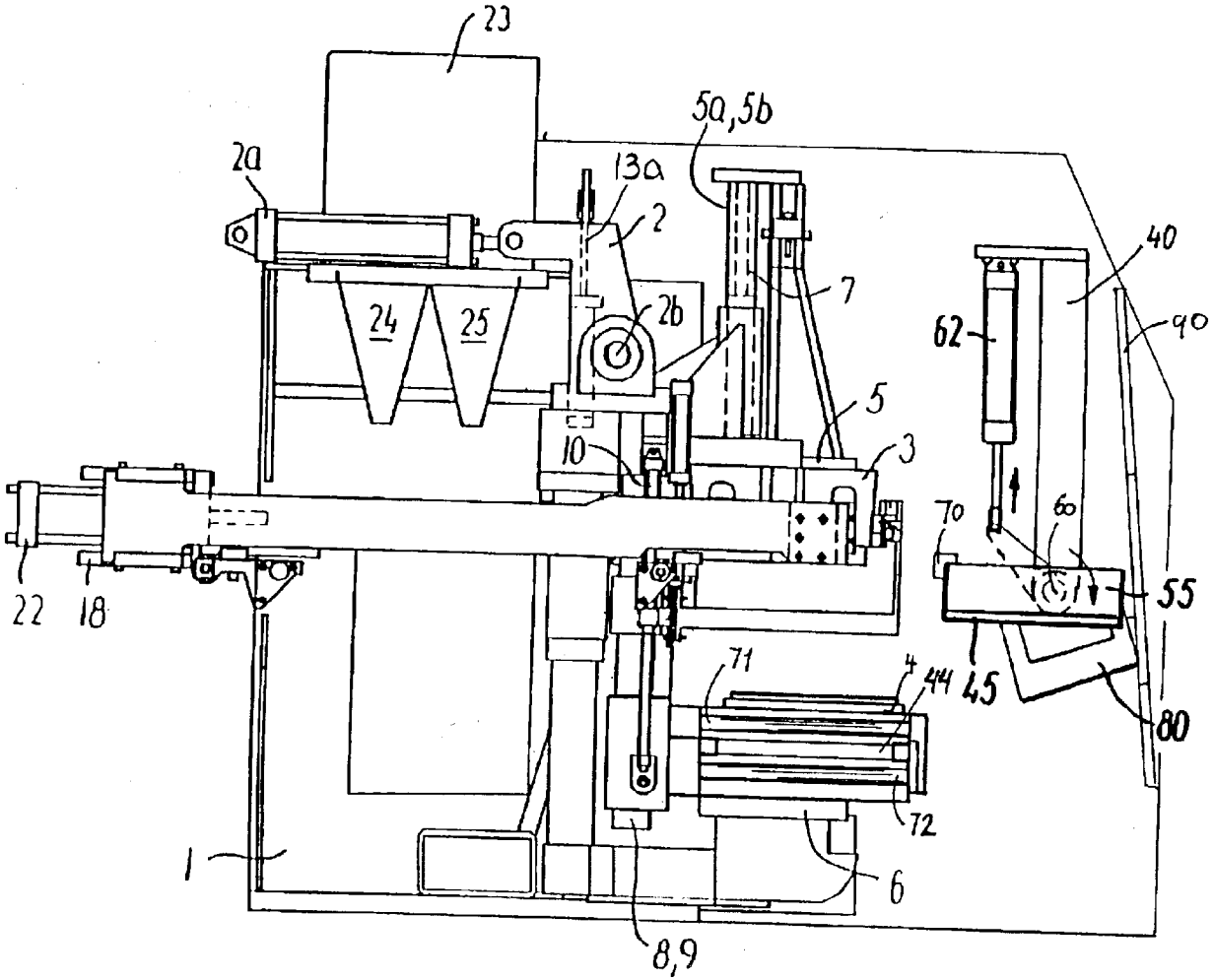
FIG. 2 shows a view of the moulding machine from the side in a next state in which the core-mask has moved to the core-releasing position.

After the core mask 45 has been loaded with cores 50, vacuum is applied to retain the cores 50 and the core mask 45 is swung to the core releasing position as indicated by the arrow in FIG. 2. In this position the cores face downwardly.

Figure 3:
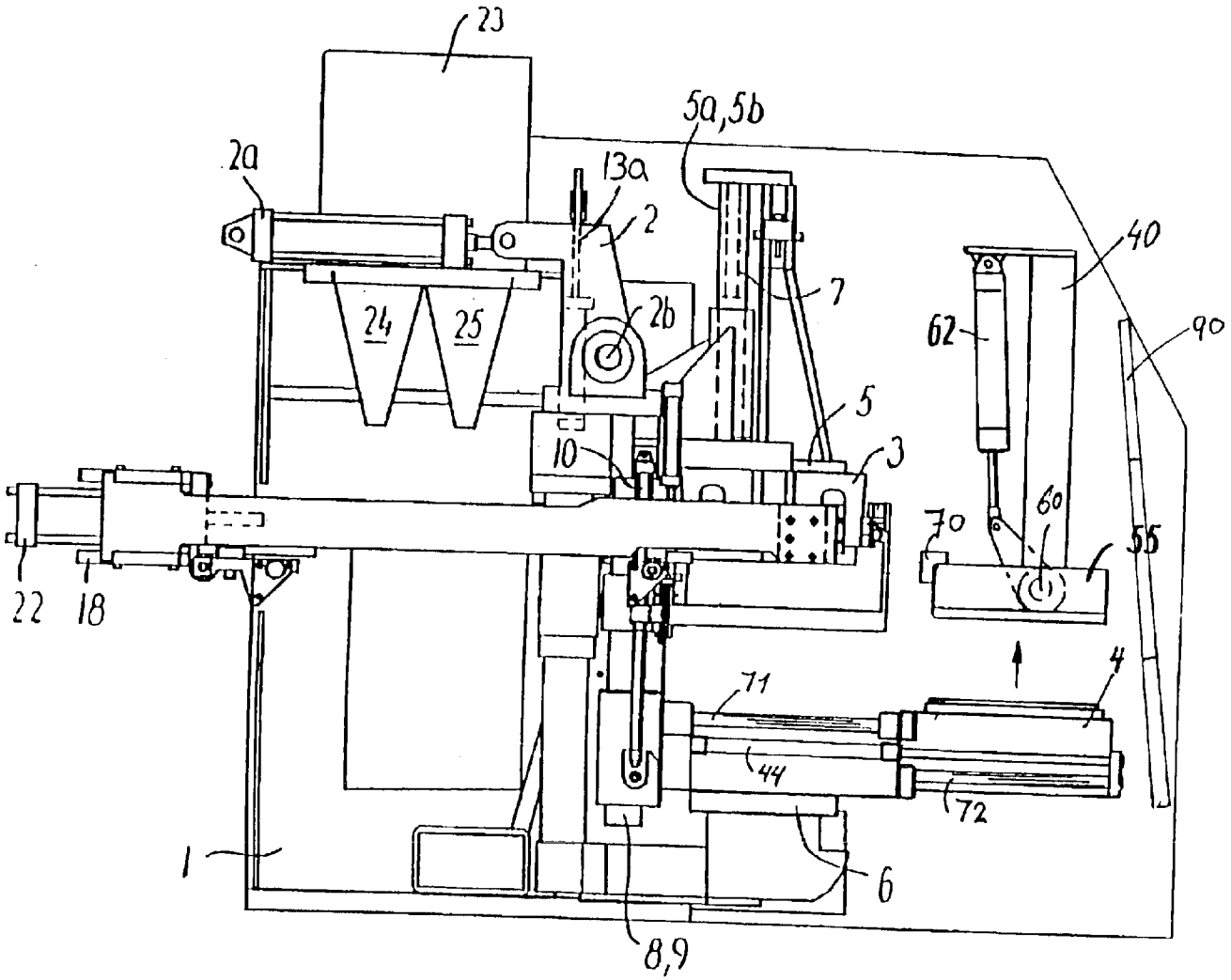
FIG. 3 shows the same view in a next step in which the drag flask has moved under the core mask.
Figure 4:
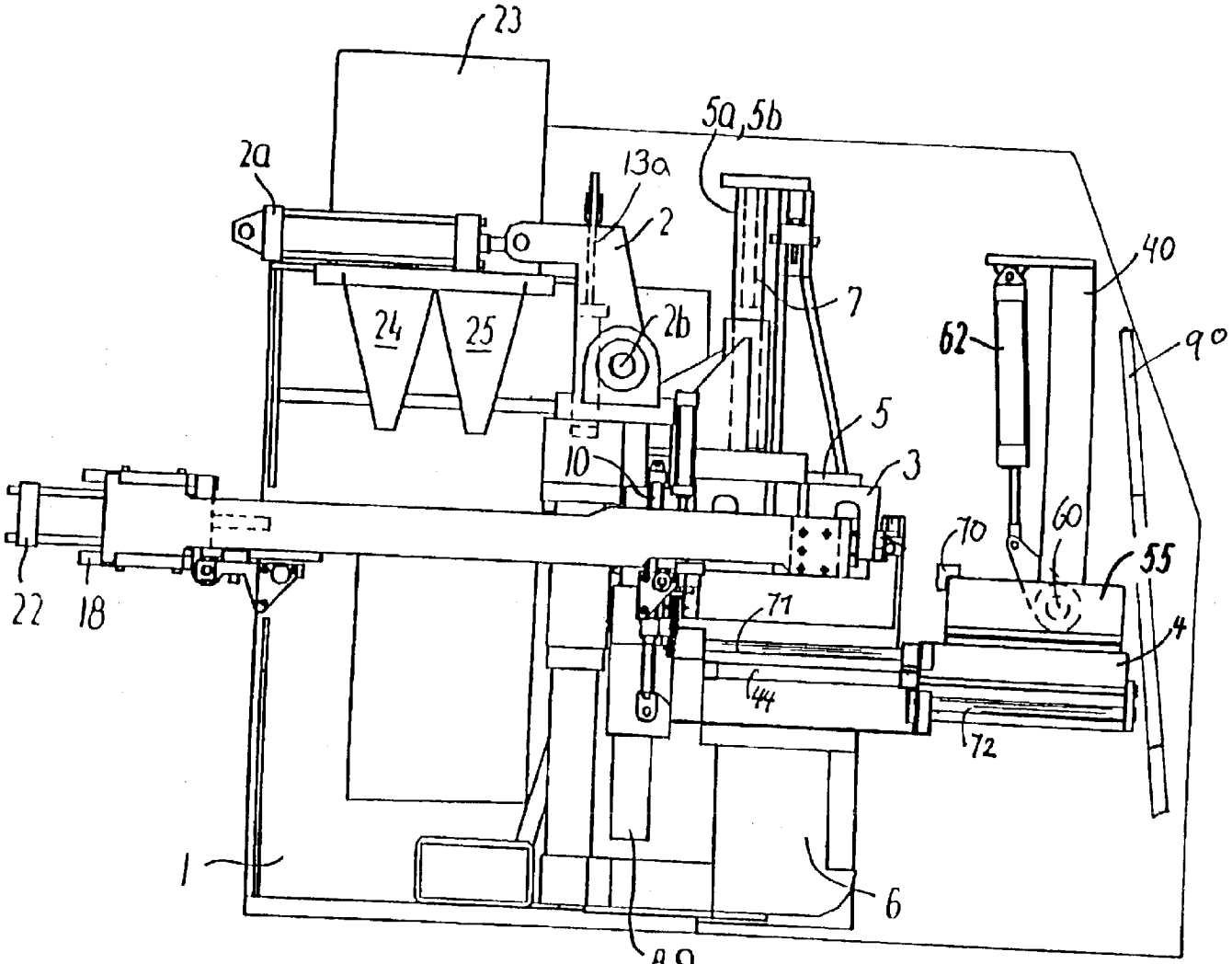
FIG. 4 shows the same view in following step in which the drag flask has moved up to the core mask.
Figure 5:
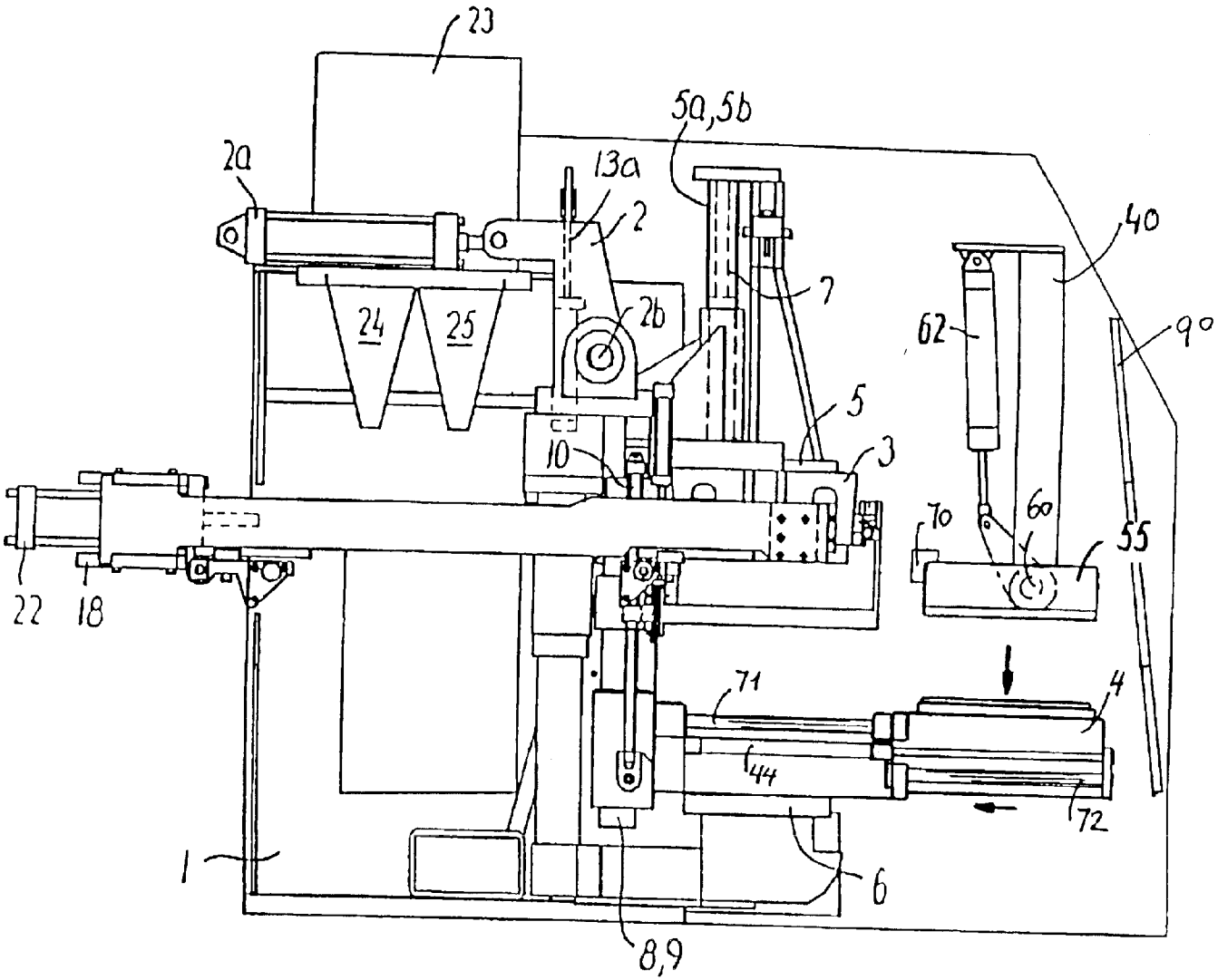
FIG. 5 shows the same view in the following step in which the drag flask is moved down.

In the next step the drag flask 4 is moved by the seventh hydraulic cylinder 44 in a horizontal direction from the position directly under the cope 3 flask to a core-setting position directly under the core mask 45 as indicated by the arrow in FIG. 3.

Figure 6:
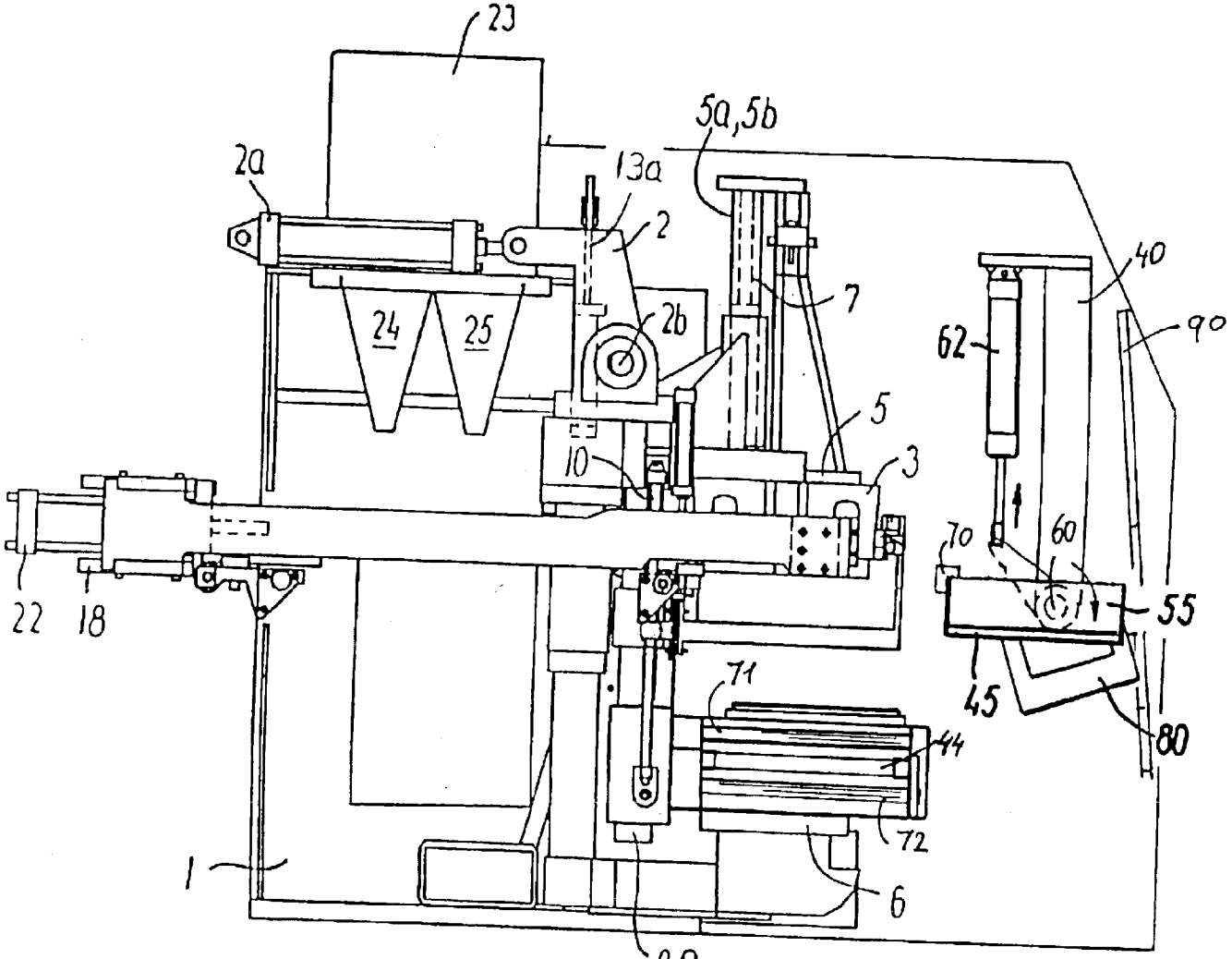
FIG. 6 shows the same view in the following step in which the drag flask is moved under the cope flask again.

The drag flask 4 is thereafter moved upwards (FIG. 4) as indicated by the arrow in FIG. 3 towards the core mask 45 by the second actuator 10. Within the drag flask 4 is a mould half (a drag) formed in the previous production cycle. The drag flask 4 is raised until the cores 50 are pressed into the cavities in the mould. The cores 50 which were held in the core mask by means of vacuum are now released by no longer applying a vacuum. Thus the cores 50 are set in the cavities of the mould and the drag flask 4 is moved downwards again (FIG. 5) and next moved in a horizontal direction to be positioned directly under the cope flask 3 (FIG. 6). Thereafter core mask 45 is swung from its core-releasing position towards its core-loading position as indicated in FIG. 7 over an angle of 90° to 110°, depending on the preferred core-loading angle (0° to 15° with the vertical).

Figure 7:
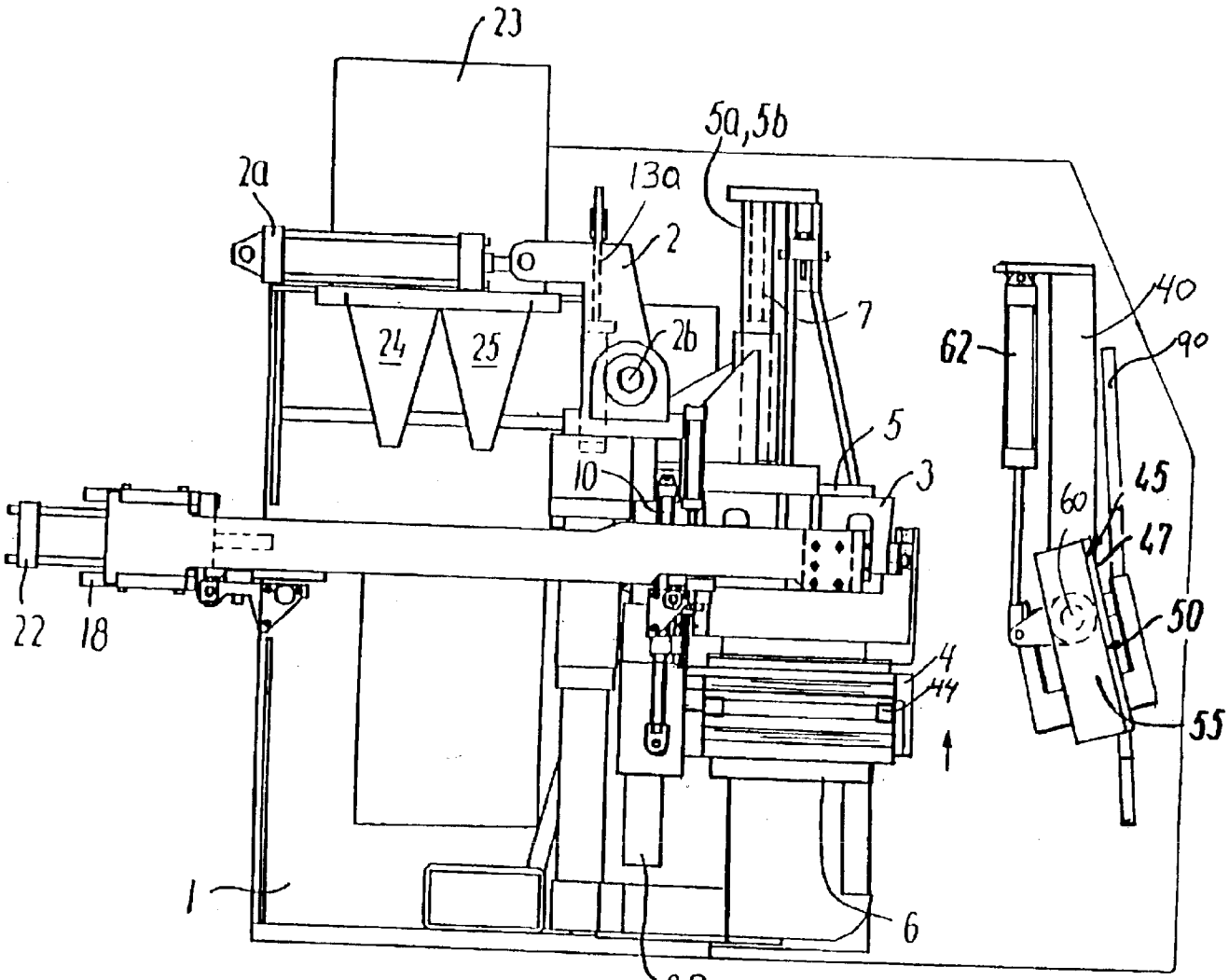
FIG. 7 shows the same view in the following step in which the core-mask is swung up to the core-loading position and the drag flask is moved up to the cope flask.

While the operator is busy loading the cores in the core mask, the drag flask 4 is raised until the upper surface of the drag flask 4 is in contact with the lower surface of the cope flask 3, causing the mould surface of the cope to be brought in contact with the mould surface of the drag with the cores 50 placed in the mould cavities (FIG. 7).

Thereafter (not shown), the first squeeze plate 5 is lowered to separate the cope and the drag from the cope flask 3 and the drag flask 4. The second squeeze plate 6 is simultaneously lowered and serves as a table for the superposed cope and drag and transports the cope and drag downwards to a position in which the superposed drag and flask can be expelled from the moulding machine. In the next step (not shown) a sixth hydraulic actuator 28 pushes the superposed cope and drag from the lowered squeeze plate 6 onto a conveyor means adjacent to the machine.

The moulding apparatus continues by lowering the drag flask 4 and displacing the pattern plate 15 laterally into the space between the cope flask 3 and the drag flask 4 (operation not shown). This step is considered as the start of a new cycle. The drag flask 4 and the second squeeze plate are moved upwards towards the cope flask by the second actuator 10 and the third actuators 13*a*, respectively, thereby clamping the pattern plate between the cope flask 3 and the drag flask 4.

Figure 8:
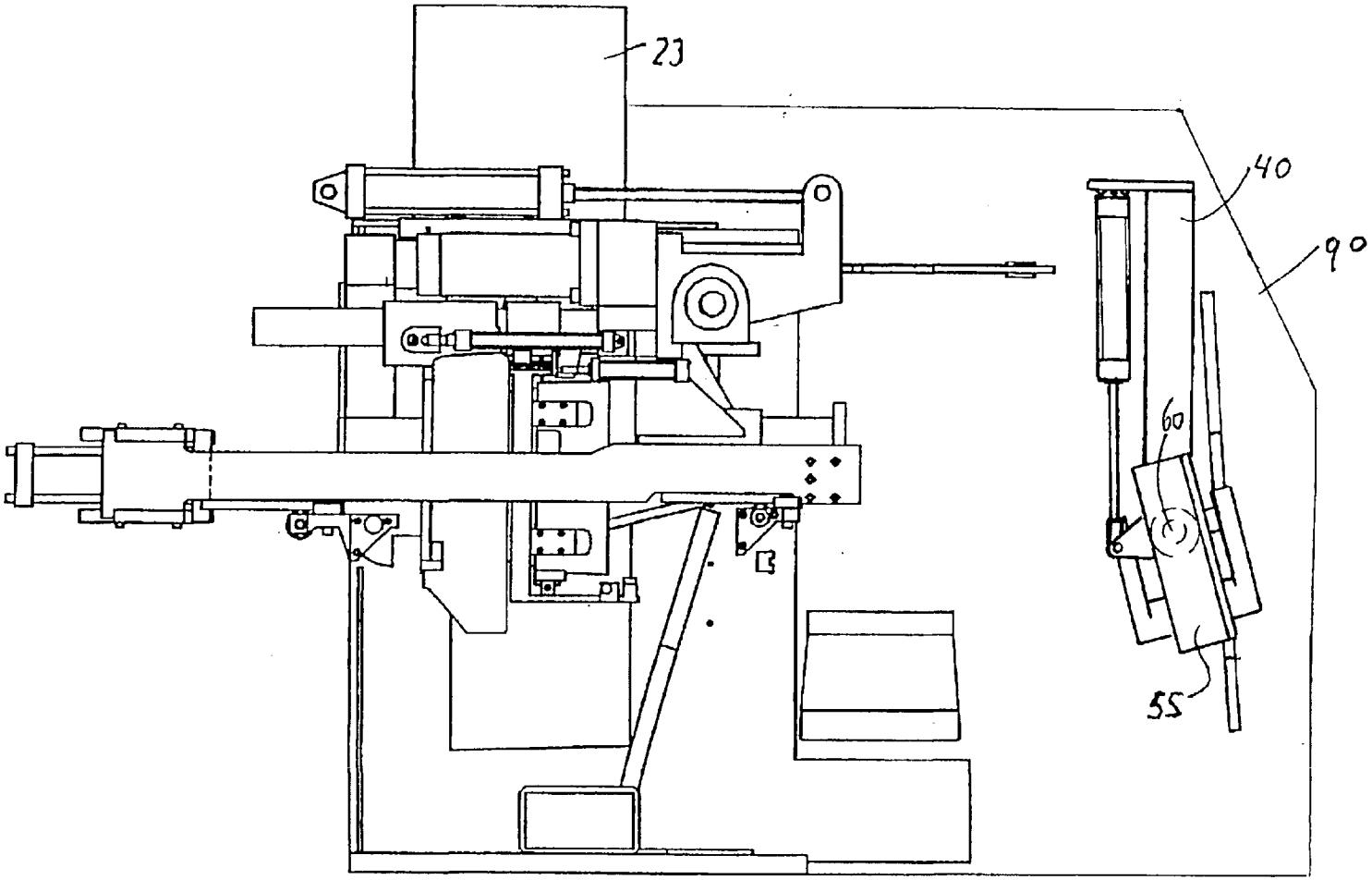
FIG. 8 shows the same view in the following step in which the swing frame is swung 90°.

In the next step, the swing frame 2 is rotated over a 90° from the horizontal position to the vertical position by the hydraulic actuator 2*a* as shown in FIG. 8. The sand-blowing nozzles 24, 25 of the blow head 23 now abut with the sand-charging openings 12 of the respective flask. In the following step, the mould-half-forming spaces of the flasks are filled with sand by supplying pre-pressed air into the blow head 23. Then the sand is compacted by actuating the fifth actuator acting on the compression frame. As a result, a cope and a drag are moulded by compression in the cope flask 3 and the drag flask 4. After a pre-determined interval, the swing frame 2 is rotated over 90° back from the vertical position to its starting position, in which the cope flask 3 and drag flask 4 take their horizontal positions.

In the next step, the drag flask 4 and the lower squeeze plate 6 are lowered in unison and the pattern plate is lowered to take its position in between the cope flask and the drag flask, causing the pattern plate to separate from the cope flask 3 (not shown). The pattern plate is retracted from the space between the cope flask 3 and the drag flask 4 and the same state of the production cycle as in FIG. 1 is reached and is ready for the next cycle which can repeated for mass production of flaskless moulds.

Thus, the operator has nearly the complete production-cycle time available for loading the cores 50 in the core mask 45.

Although a specific embodiment of the moulding machine has been described above, various modifications are possible within the scope of the invention as defined in the claims. The cores 50 may for example be retained in the core mask mechanism or pneumatically with inflatable members.

The core mask 45 swing is not limited to the eighth hydraulic actuator 62 but can be effected by any other conventional actuator, such as a pneumatic actuator or an electric actuator, or the swing be effected manually.

The core setter swing 40 can be effected by any other suitable actuator instead of a ninth hydraulic actuator. Other examples of suitable actuator types are pneumatic actuators and electrical actuators. The swing may also be effected manually.

LIST OF REFERENCE NUMERALS

| | |
|---|---|
| 1 | base frame |
| 2 | swing frame |
| 2a | actuator |
| 2b | shaft |
| 3 | cope flask |
| 4 | drag flask |
| 5 | first squeeze plate |
| 5a | guide rod |
| 5b | guide rod |
| 6 | second squeeze plate |
| 7 | first actuator |
| 8 | guide rod |
| 9 | guide rod |
| 10 | second actuator |
| 12 | sand-charging opening |
| 13a | third actuator |
| 18 | compression frame |
| 22 | fifth linear actuator |
| 23 | blowhead |
| 24 | sand-blowing nozzle |
| 25 | sand-blowing nozzle |
| 28 | sixth actuator |
| 33 | bracket |
| 34 | guide frame |
| 40 | core setter |
| 44 | seventh hydraulic actuator |
| 45 | core mask |
| 47 | flat side |
| 49 | pocket |
| 50 | core |
| 55 | core frame |
| 60 | first horizontal shaft |
| 62 | eight hydraulic actuator |
| 70 | braces |
| 71 | guide rod |
| 72 | guide rod |
| 80 | subframe |
| 90 | light curtain |

What is claimed is:

1. A moulding machine for producing flaskless moulds comprising:

a drag flask and a cope flask arranged to be movable relatively towards one another, a core setter for placing cores in upwardly facing cavities of a mould located in the drag flask, the core setter comprising a core mask with pockets selectively operable to hold and release cores, said core mask being supported by a holder that is pivotably journalled around a horizontal axis to swing between a core-releasing position and a core-loading position, the core mask facing downwardly towards the mould when it is in the core-releasing position and facing laterally away from said mould when it is in the core-loading position, the drag flask being arranged to be movable in a substantially horizontal direction to and from a core setting position directly under the core mask in its core-releasing position, and the drag flask being arranged to be movable upwards to- and downwards from the core mask when it is in the core setting position.

2. A moulding machine according to claim 1, wherein the holder is supported by lateral shaft that is pivotally supported by the frame of the moulding machine.

3. A moulding machine according to claim 1, comprising points of support which give support in a vertical direction and which come in contact with the holder when it is in the core-releasing position for reducing bending of the holder when the cores are pressed into the mould.

4. A moulding machine according to claim 1, wherein the core mask swings over an angle of 90°–110° from the core-releasing position to the core-loading position at which the core mask forms an acute angle of approximately 15° with the vertical so that the core mask faces slightly upwards.

5. A moulding machine according to claim 1, wherein the holder is pivotably journalled around a second substantially horizontal axis for swinging the core setter away from a core setting area of the moulding machine in order to make place for manual core setting or manual blowing off of residual sand on a mould.

6. A moulding machine according to claim 1, wherein the cope and drag flask are arranged to be rotated between a substantially horizontal position and a substantially vertical position.

7. A moulding machine according to claim 1, comprising a light curtain securing the core-setting area, whereby a part of the light curtain is interrupted by the holder when the holder is in the core-loading position and is deactivated when the holder is in the core-loading position.

8. A moulding machine according to claim 1, wherein the cores are retained in the pockets of the core mask by vacuum means.

* * * * *